US008146462B2

(12) United States Patent
Galloway et al.

(10) Patent No.: US 8,146,462 B2
(45) Date of Patent: Apr. 3, 2012

(54) CAM COMPRESSION TOOL

(76) Inventors: Bruce Galloway, Charlottesville, VA (US); Henry Frickel, Bel Air, MD (US)

( * ) Notice: Subject to any disclaimer, the term of this patent is extended or adjusted under 35 U.S.C. 154(b) by 13 days.

(21) Appl. No.: 12/185,382

(22) Filed: Aug. 4, 2008

(65) Prior Publication Data

US 2009/0031866 A1 Feb. 5, 2009

Related U.S. Application Data

(60) Provisional application No. 60/962,985, filed on Aug. 2, 2007.

(51) Int. Cl.
*B25B 7/04* (2006.01)

(52) U.S. Cl. ..... 81/385; 81/406; 81/416

(58) Field of Classification Search ..... 81/117, 81/416, 98, 99, 385, 405–407, 409.5, 393, 81/342, 347, 349
See application file for complete search history.

(56) References Cited

U.S. PATENT DOCUMENTS

| | | | | |
|---|---|---|---|---|
| 1,866,771 | A | 9/1845 | Johnson | |
| 228,333 | A * | 6/1880 | Fawcett | 81/406 |
| 460,230 | A | 9/1890 | Gunnarson | |
| 562,260 | A * | 6/1896 | Toquet | 30/193 |
| 591,720 | A | 10/1897 | Armstrong | |
| 651,574 | A | 6/1900 | Meredith | |
| 656,394 | A * | 8/1900 | Deiters et al. | 81/406 |
| 676,318 | A | 3/1901 | Jackson | |
| 794,249 | A | 12/1904 | Peterson | |
| 816,278 | A | 8/1905 | Tracht | |
| 1,337,678 | A | 5/1917 | Williams | |
| 1,441,372 | A | 4/1921 | Pickard | |
| 2,210,274 | A | 6/1937 | Becklin | |
| 2,212,801 | A | 9/1937 | Torbert | |
| 2,467,658 | A | 2/1946 | Carnelli | |
| 2,461,272 | A | 8/1946 | Hanson, Jr. | |
| 2,822,715 | A | 5/1955 | Raimondi | |
| 2,958,246 | A | 12/1958 | Osbora | |
| 3,659,485 | A | 5/1972 | Roth | |
| 3,939,739 | A | 2/1976 | Kotsakis | |
| 4,651,597 | A | 3/1987 | Yang | |
| 4,913,011 | A | 4/1990 | Ma | |
| 5,176,048 | A * | 1/1993 | Jore et al. | 81/352 |
| 6,026,714 | A | 2/2000 | Chang | |
| 6,092,440 | A | 7/2000 | Hillinger | |
| 6,205,892 | B1 | 3/2001 | Davidson | |
| 6,401,578 | B1 | 6/2002 | Domenge | |
| 6,658,971 | B2 | 12/2003 | Delbrugge | |
| 7,044,033 | B2 * | 5/2006 | Hirse | 81/418 |

(Continued)

FOREIGN PATENT DOCUMENTS

DE 102006039759 2/2008

*Primary Examiner* — Debra S Meislin
(74) *Attorney, Agent, or Firm* — Sheldon H. Parker, Esq.

(57) ABSTRACT

A variable compression tool comprising a retaining surface attached to a lever arm and a cam surface attached to a second lever arm. The two arms are moveably connected through a fixed pivot point. The profile of the jaw pocket may be of various shapes. In one instantiation, the jaw pocket conforms to at least two sides of a nut. The orientation of the cam surface to the jaw pocket is such that the force generated by closing the jaws forces the nut into the retaining surface. Adjustment of the cam lever arm is regulated by an eccentric cam adjuster bearing which changes the effective center of rotation of lever arm two in two dimensions simultaneously by rotation of the bearing.

9 Claims, 9 Drawing Sheets

U.S. PATENT DOCUMENTS

| | | | | |
|---|---|---|---|---|
| 7,143,671 | B1 | 12/2006 | Lai | |
| 7,201,084 | B2 | 4/2007 | Yap | |
| 2004/0129117 | A1 | 7/2004 | Hirse | |
| 2005/0262974 | A1 | 12/2005 | Engvall | |
| 2006/0219852 | A1 * | 10/2006 | Kawai et al. | 248/213.1 |
| 2006/0266164 | A1 | 11/2006 | Gao | |

* cited by examiner 32
42
18
20
30
26
34
12
14

42
32
20
30
26
34
12
14

142
120
134
114
112

CAM COMPRESSION TOOL

FIELD OF THE INVENTION

The present invention relates to mechanical tools and, more particularly, to wrenches and other devices designed to apply pressure to an object placed between two jaws of a tool.

BACKGROUND OF THE INVENTION

Wrenches and other hand tools often can not exert enough force to grip an object securely. In the case of wrenches, rusted, frozen and undersized nuts are often difficult to remove and become further deformed by the action of the wrench jaws. Wire cutters and other hand tools that apply an increasing force on an object between jaws of a hand tool often lack sufficient mechanical advantage to function with wire of more than a small gage.

Pliers, socket wrenches, open end wrenches, vise grips type devices and pipe wrenches are well known.

Wrenches which function as an approximation of the nut head, such as open end wrenches and socket wrenches, must by necessity be slightly oversized so that they can accommodate a rusted nut and so that they can be applied and removed easily. This mismatch between the nut head and the wrench face will tend to reduce mechanical efficiency and limit the gripping force exerted upon the faces of the nut. Likewise traditional wire cutters have a limited leverage and force which can be exerted on the wire or other material to be cut when inserted between jaws of the tool.

Vise grip tools enable an adjustable degree of leverage to increase pressure on the object grasped. Problems with the vise grip include high pressure on the handles in order to get a tight grip, a tendency to distort or destroy the surface of the object gripped, high pressure required to release the grip, and lack of any feedback or "mechanic's feel" when using the vise grip.

Traditional pliers are usually made to fit a large range of sizes of nut or object to be gripped. Conventional pliers are severely limited in the amount of mechanical advantage they provide and often strip nut heads because of the mechanical force fed back into the handles when the closed pliers is turned forces the handles open and releases the grip on the nut.

SUMMARY OF THE INVENTION

In accordance with the present invention, there is provided a tool comprising at least one movable arm with an integral or attached cam surface and a second opposing retaining surface to which the cam surface is moveably related such that closing the movable arm causes the cam surface to press against an object set between the cam surface and a retaining surface. The compression force is proportional to the degree of closure of the arm and the cam is angled relative to the retaining surface to apply force perpendicular to the retaining surface.

A feature of the preferred instantiation of the invention is to provide a compression hand tool which can be used to apply variable pressure to an object placed between a retaining surface and of an opposing cam surface.

It is another feature of the preferred instantiation of the invention to provide for regulation of the pressure applied by closing the arms of the tool.

It is another feature of the preferred instantiation of the invention to enable the turning force of the tool to be independent of the amount of compression exerted.

It is another feature of the preferred instantiation of the invention to align the cam surface relative to the retaining surface such that closing the lever arms results in a force vector at an angle to the center line so that the nut or other intervening object is driven into the pocket of the jaw. In the case of a nut, the resulting force tends to form the nut head into the vertex and side shapes of the jaw pocket.

It is another feature of the preferred instantiation of the invention to adjust for a range of sizes of intervening object by the design of the cam surface. In particular a slightly under or over sized nut can be accommodated at one setting of the levers and rounded or stripped nuts will be compressed to restore their original edges by compression of the cam surface against the pocket of the jaw.

It is another feature of the preferred instantiation of the invention to enable the cam arm to be adjustable so that the distance from the cam surface to the opposing surface may be increased or decreased.

In accordance with another feature of the preferred embodiments of the invention an adjustable cam wrench has handles, or lever arms. One lever arm has a retaining surface for a nut or bolt. The retaining surface contacts two or three faces of the nut, depending upon the size of the nut. The other lever arm has a cam surface. Both lever arms rotate about a fixed pivot. One lever arm, most preferably the lever arm with the cam surface is rotatably fixed to a bearing member and the bearing member is rigidly fixed to the fixed pivot. Most important, is that the fixed pivot is positioned off center, that is, non-concentric with respect to the bearing. Accordingly, the bearing and the fixed pivot have an offset center of rotation. A lever arm position adjuster fits over the bearing and locks to it, preferably with a transverse pin that enables the arm position adjuster to rotate in a plane parallel to the plane of the body of the wrench. Rotation of the adjuster arm varies the distance between the cam surface and the fixed pivot.

In accordance with another feature of the present invention one end of the arm position adjuster is fitted with one or more locking pins that fit into engagement holes formed in the lever arm having the cam surface. The arm position adjuster is pivotable about a transverse pin that locks the arm position adjuster to the bearing.

In accordance with another feature of the invention a wrench is provided which has a pair of lever arms that rotate about a fixed pivot. The position of one lever arm is variable relative to the fixed pivot. The lever arm whose position is variable relative to the fixed pivot is provided with a bearing member. The fixed pivot is mounted in the bearing non-concentric with the bearing whereby movement of the position adjuster from the position in which the wrench accommodates a large nut or bolt head to the position in which the wrench accommodates a small nut, increases the distance between the cam surface and the fixed pivot. The cam surface lever arm is in a rotational relationship with the bearing, and accordingly, has an eccentric relationship with fixed pivot. It should be noted that the term "cam surface" refers to a surface which bears against one face of a nut and forces the nut into engagement with a nut retaining region of the other lever arm. The cam or bearing surface of the lever arm forces the nut into the vertex formed by the intersection of the face of the nut retaining region of a lever arm essentially parallel to the cam surface and a second face of the nut retaining region. The nut retaining region has an open end and a closed end and the second face is at the closed end. Thus, a nut is always forced against two nut retaining faces, irrespective of the size of the nut.

In accordance with another feature of the invention a wrench is provided with a tapered relief angle of the distal ends of the lever arms such that nuts attached to a flat surface may be approached by holding the cam compression tool at an angle to the work surface.

BRIEF DESCRIPTION OF THE DRAWINGS

A complete understanding of the present invention may be obtained by reference to the accompanying drawings, when considered in conjunction with the subsequent, detailed description, in which.

For purposes of clarity and brevity, like elements and components will bear the same designations and numbering throughout the Figures.

DESCRIPTION OF THE PREFERRED EMBODIMENTS

It should be noted that the discussion of the theory of operation as presently understood is by way of providing a better understanding and does not limit the scope of the invention.

Figure 1:
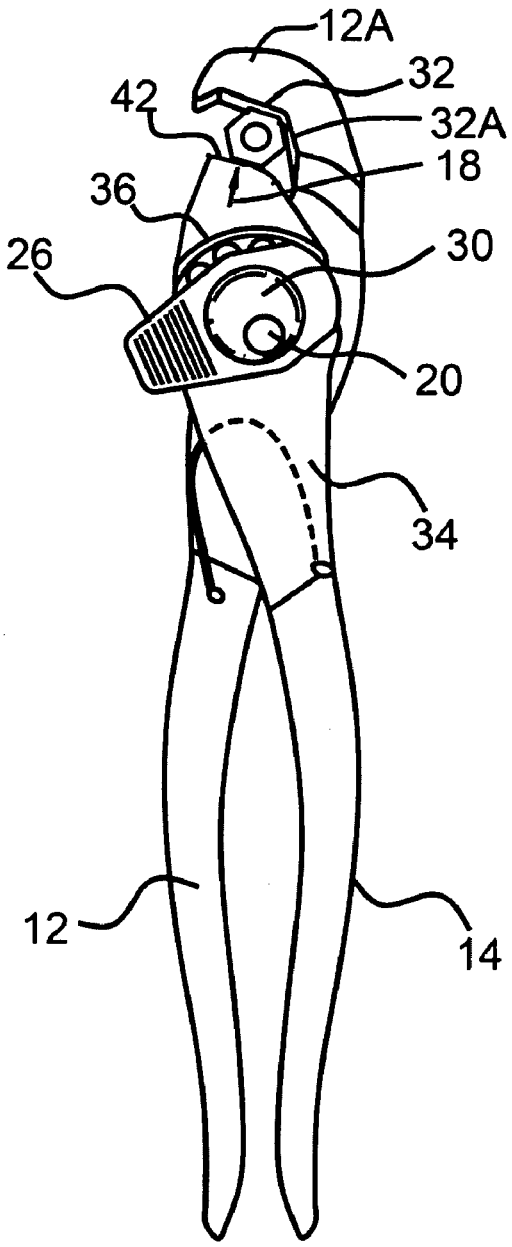
FIG. 1 is a front view of an adjustable cam compression wrench adjusted to the smallest opening position in accordance with the disclosure.

FIG. 1 is a front view of an adjustable cam wrench with handles, or lever arms, 12 and 14 at their minimum distance from each other. The Figure shows the first lever arm 12 and second lever arm 14 that are configured as well known in the art for user comfort. The retaining surface 32 of the fixed jaw and cam surface 42 extend from lever arm 12 and lever arm 14 respectively and are connected at a fixed pivot 20 with an associated adjuster bearing 30. The bearing 30 and fixed pivot 20 have an offset center of rotation. The arm position adjuster 26 fits over the bearing 30 and locks to it with a transverse pin (not shown) that enables the arm position adjuster 26 to rotate horizontally relative to the body of the wrench. That is, it rotates in a plane essentially parallel to the plane of the body of the wrench. One end of the arm position adjuster 26 is fitted with one or more locking pins 38 (FIG. 15) that fit into engagement holes 36 formed in lever arm 12.

Arrow 18 represents the contact region between the cam surface 42 and the nut. The cam surface contact region is on the region of the face of the nut away from the closed region 32A of the retaining surface 32 of the fixed jaw 21A of the lever arm 12. It should be noted that the term "fixed" is used to indicate that it rotates about a fixed pivot 20, whereas the cam surface 42 path of movement is dependent upon the position of the position adjuster 26, and thus is not fixed.

While both arms rotate about the fixed pivot 20 the position of lever arm 14 and its cam surface 42 are is variable relative to the fixed pivot 20. Since the pivot 20 is not concentric with the bearing 30 movement of the position adjuster from the position in which the wrench accommodates a large nut or bolt head to the position in which it accommodates a small nut, increases the distance between the cam surface and the fixed pivot 20. The terms nut and bolt are used herein interchangeably, and most typical are hexagonal. The term "hex head" is commonly employed to indicate such elements. As evident from FIG. 10, the bearing 30 is received in hole 30A. Accordingly, lever arm is in a rotational relationship with bearing 30, and accordingly, a eccentric relationship with fixed pivot 20, since pivot 20 is not concentrically positioned with respect to bearing 30.

Figure 8:
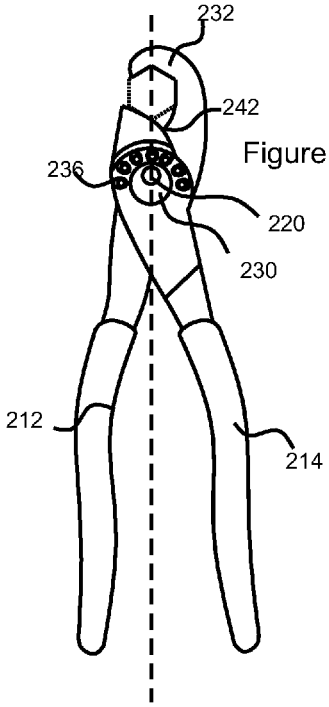
FIG. 8 is a front view of an adjustable cam wrench having an alternative orientation of the retaining surface and cam surface and showing details of the arm position adjuster in accordance with the disclosure.

The arm position adjuster 26 is utilized by pressing down on the end opposite the locking pins 38 and rotating the arm position adjuster 26 to a point such that the locking pins 38 engage with one or more engagement holes 36. Rotation of the arm position adjuster 26 serves to reposition lever arm 14 relative to the fixed pivot 20. In the preferred instantiation the rotation of the bearing adjuster 26 results in the cam surface 42 moving relative to the retaining surface 32 such that the point of contact of the cam surface 42 is maintained in the same relative position for a variety of sizes of hexagonal nuts. The point of contact and the orientation of the retaining surface 32 to the nut is such that closing the handles of the wrench drives the nut into the retaining surface 32. In order to provide a better grip, the cam surface 42 has a slight convexity on the order of about five (5) degrees, as indicated in FIG. 8. An opening spring 34 is preferably fitted to aid in "ratcheting" the wrench so that it tends to open when the handles are released to enable a partial rotation of the wrench relative to the nut head without removing the tool from the nut.

It should be noted that any other method known in the art can be used to adjust the position of the cam surface and that the arm position adjuster illustrated herein is for example. The critical feature is the ability to adjust and retain the cam surface, through adjustment of the bearing, in one or more positions relative to the retaining surface.

The caming action, in addition to the slight convexity, serves to enable a user to apply a greater amount of pressure than can be attained using a flat contact surface.

Figure 2:
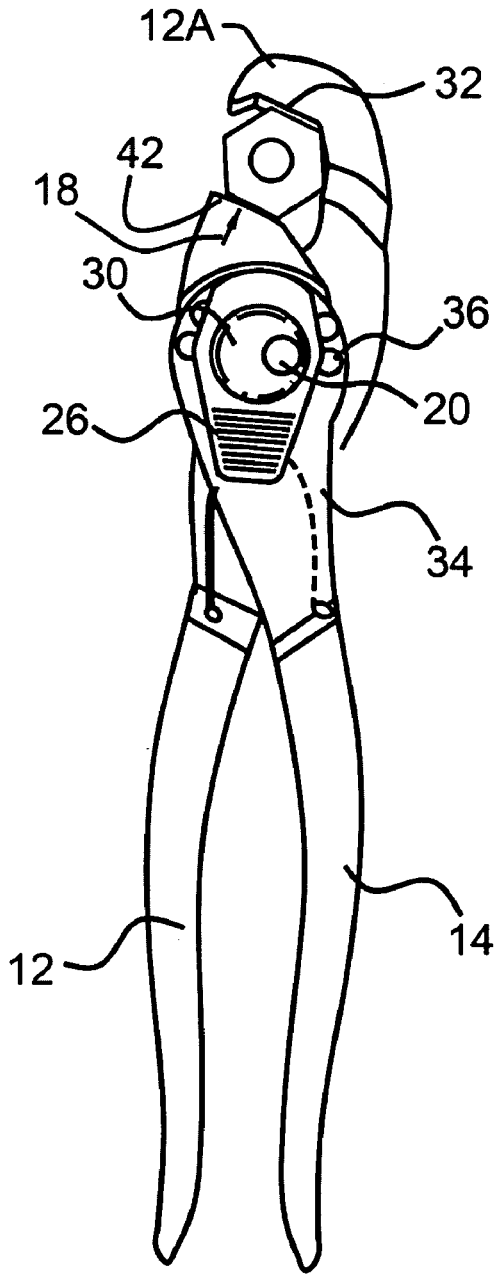
FIG. 2 is a front view of an adjustable cam wrench with arm position adjuster at a middle opening position in accordance with the disclosure.

FIG. 2 is a front view of the wrench of FIG. 1 but with the arm position adjuster 26 selecting a medium setting.

Figures 3, 4, 5:
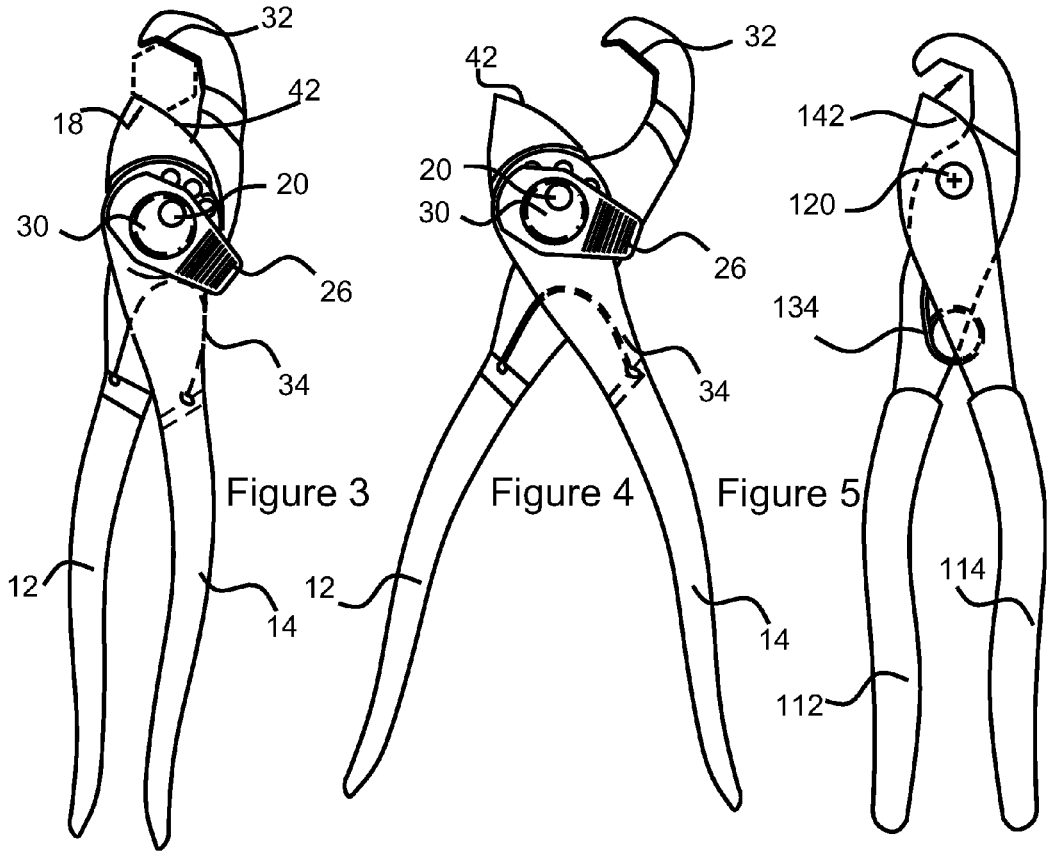
FIG. 3 is a front view of an adjustable cam wrench with arm position adjuster at the fully opened position in accordance with the disclosure.
FIG. 4 is a front view of an assembled wrench with arm position adjuster opened to maximum position fully opened in accordance with the disclosure.
FIG. 5 is a front view of a non-adjustable alternate embodiment of a fixed pivot cam wrench in accordance with the disclosure.

FIG. 3 is a front view of the wrench of FIG. 1 with the arm position adjuster 26 selecting the largest setting, enabling the maximum distance between the cam surface 42 and the retaining surface 32. In FIG. 4 the lever arms 12 and 14 have been opened to their maximum separation enabled by the arm position adjuster 26 setting of FIG. 3.

FIG. 5 is a non-adjustable variant of the cam compression tool. The cam surface 142 has, in the preferred embodiment, the convexity of about less than five (5) degrees. The lever arms 112 and 114 are, as with other embodiments disclosed herein, configured for user comfort and can be covered with a not-slip material if so desired. In this embodiment the spring 134 forces the lever arms to separate when in a "resting" position. The lever arms 112 and 114 rotate around the fixed pivot 120.

Figure 6:
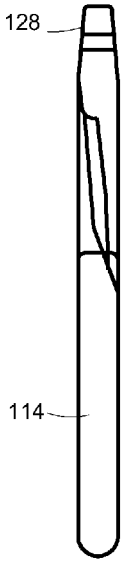
FIG. 6 is a side view of the fixed pivot wrench of FIG. 5 in accordance with the disclosure.

FIG. 6 is a side view of the wrench of FIG. 5 showing a relief angle 128 of the head enabling the wrench to be held at an angle to the work surface.

Figure 7:
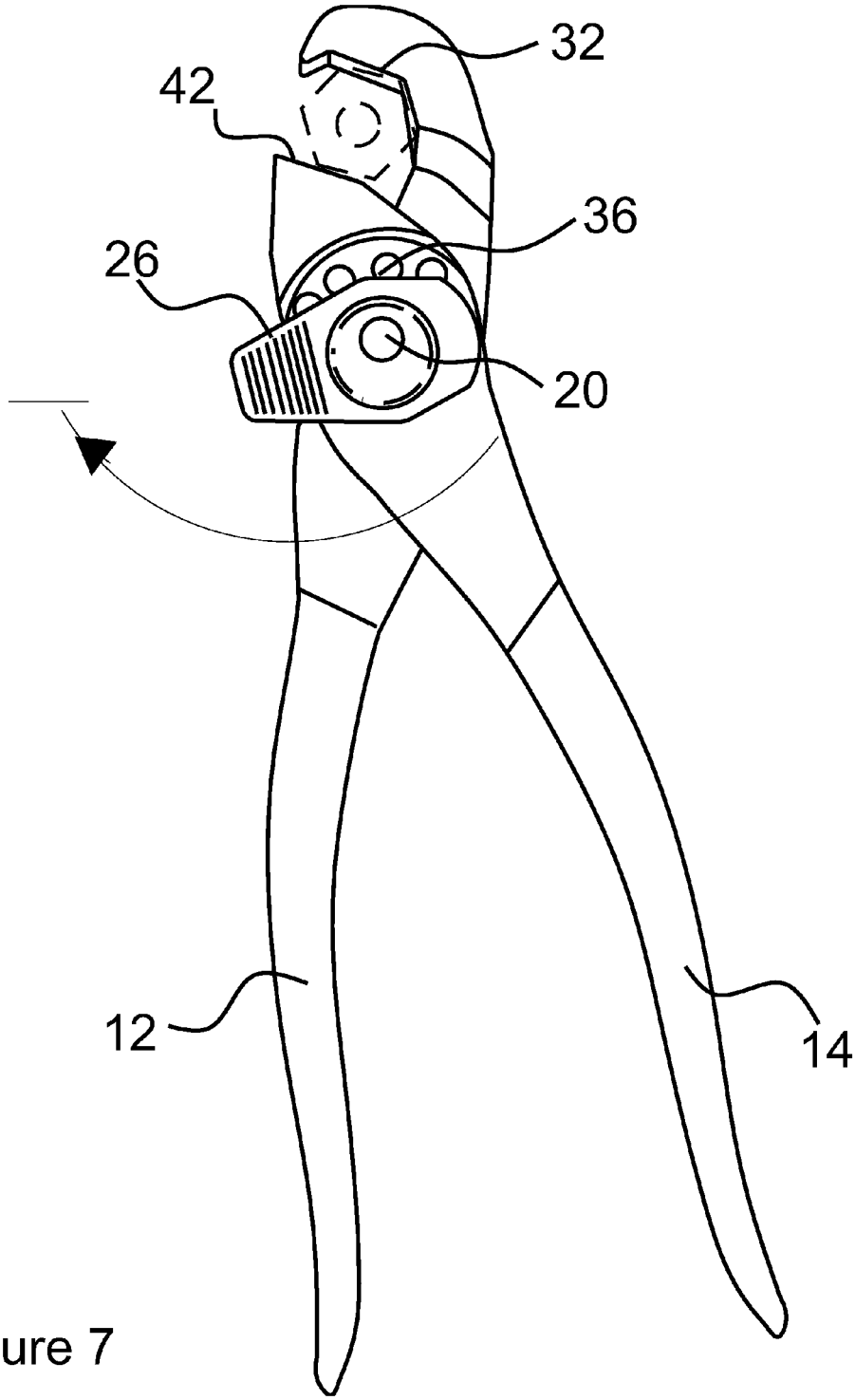
FIG. 7 is front view of the cam wrench with a side and top view of the arm position adjuster in accordance with the disclosure.

FIG. 7 illustrates the adjustable wrench showing the change in cam surface 42 position through rotation of the arm position adjuster 26.

FIG. 8 is a front view of an alternate adjustable wrench having an alternative orientation of the retaining surface 232 and cam surface 242. In this version the point of contact of the cam surface 242 and drive the nut into the retaining surface 232 from the vertex of the nut rather than the flat surface.

Figure 9:
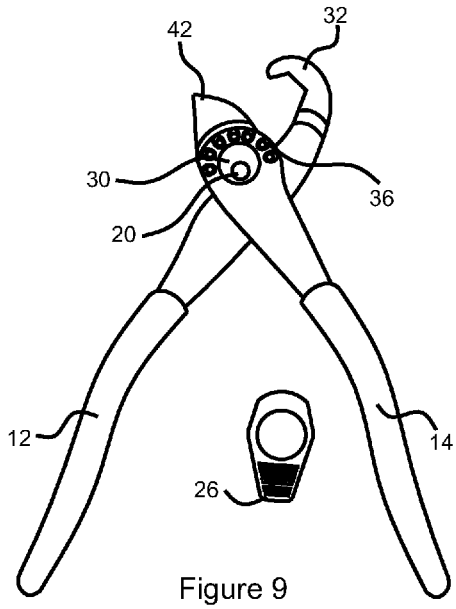
FIG. 9 is a front view of an adjustable cam compression tool with the arm position adjuster removed in a fully open position, showing the preferred orientation of the cam surface to the nut and the retaining surface in accordance with the disclosure.

FIG. 9 is a top view of a partially disassembled cam compression wrench with the arm position adjuster 26 removed to display the engagement holes 36 more fully. The placement of the pivot 20 and bearing 30 in relationship to the engagement holes 36 and also be seen in greater detail.

Figure 10:
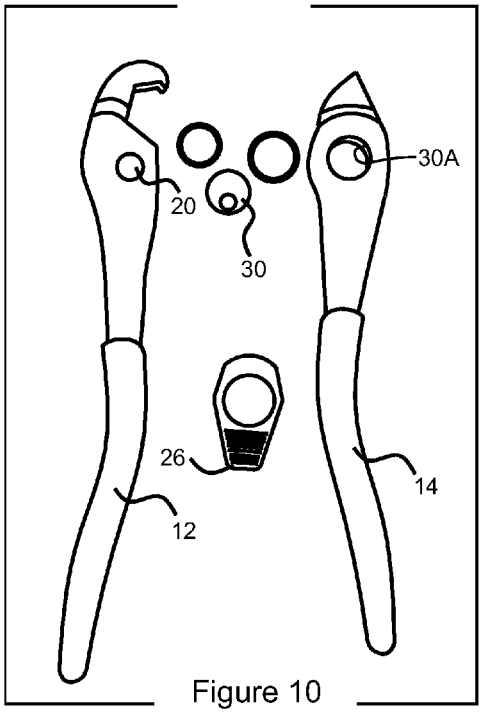
FIG. 10 is a rear exploded view of an adjustable cam wrench in accordance with the disclosure.

FIG. 10 illustrates the wrench of FIG. 1 disassembled showing all the elements, including optional spacing washers 50

Figure 11:
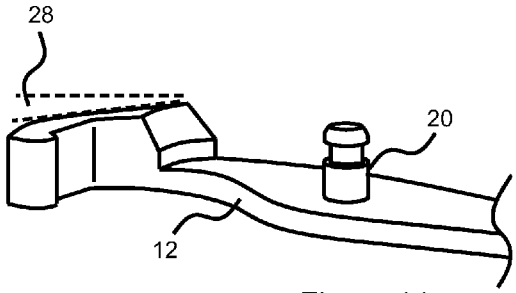
FIG. 11 is a perspective view of the lever arm pivot and relief angle of the head in accordance with the disclosure.

FIG. 11 is a perspective view of lever arm 12 showing the pivot 20 and a relief angle 28 on the head.

Figure 12:
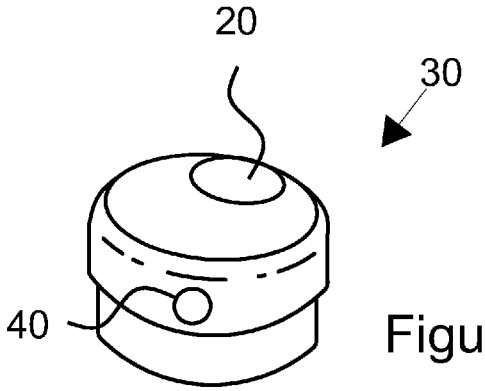
FIG. 12 is a perspective view of an adjuster bearing of an adjustable cam wrench in accordance with the disclosure.

FIG. 12 is a perspective view of the adjuster bearing 30 showing the transverse pin 40 used to maintain the bearing 30 on the pivot 20.

Figure 13:
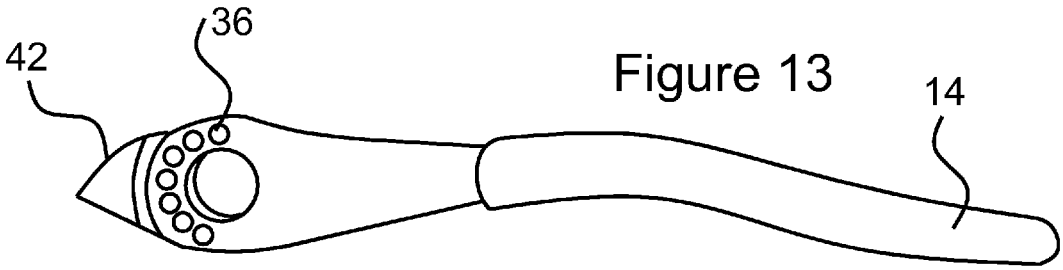
FIG. 13 is a front view of a lever arm showing engagement holes and cam surface in accordance with the disclosure.

FIG. 13 is the lever arm 14 of the cam wrench shown in FIG. 1 showing the cam surface 42 and retaining holes 36.

Figure 14:
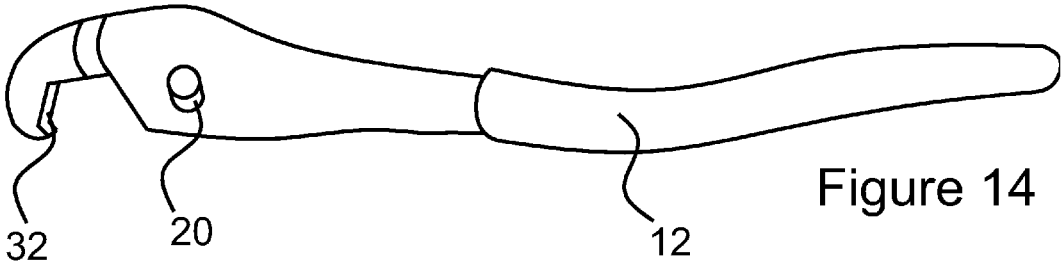
FIG. 14 is a perspective front view of a lever arm of an adjustable cam wrench with fixed pivot in accordance with the disclosure.

FIG. 14 is the lever arm 12 of the cam wrench shown in FIG. 1 showing the pivot 20 and retaining surface 32.

Figure 15:
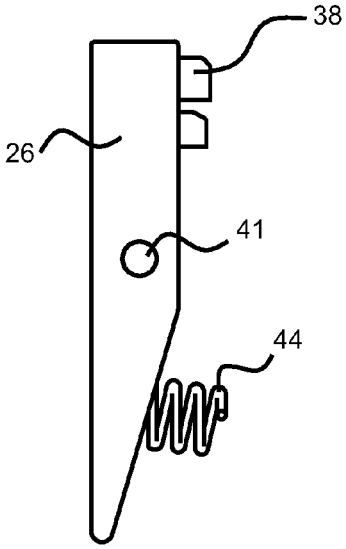
FIG. 15 is a left plan view of an arm position adjuster with pins and spring in accordance with the disclosure.

FIG. 15 is a side view of the arm position adjuster 26 showing the retaining pins 38 and receiving holes 41 for the transverse pin 40. The return spring 44 keeps the arm position adjuster 26 parallel to the surface of the wrench.

Figure 16:
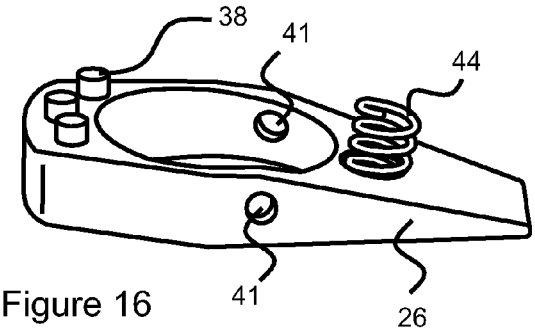
FIG. 16 is a perspective view of a arm position adjuster of an adjustable cam wrench showing pins, transverse hole and spring in accordance with the disclosure.

FIG. 16 is a perspective view of the arm position adjuster 26 showing the receiving holes 41 for the transverse pin 40 and the locking pins 38.

Figure 17:
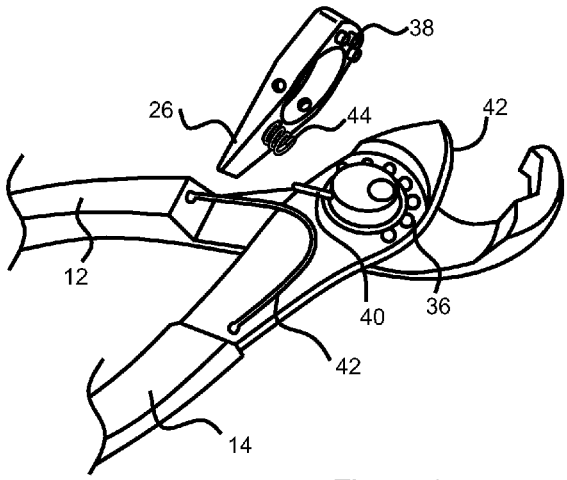
FIG. 17 is a perspective view of an adjustable cam wrench partially disassembled in accordance with the disclosure.

FIG. 17 is a perspective view of a partially disassembled led cam wrench of FIG. 1 showing the placement of the transverse pin 40 which serves as a pivot bearing for the adjuster 26 and for locking the adjuster to the bearing 30.

Figure 18:
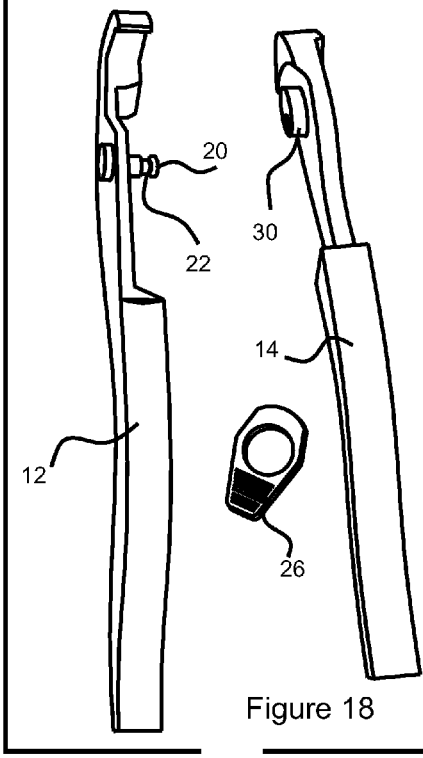
FIG. 18 is an exploded left perspective view of a cam wrench showing arm position adjuster and lever arms in accordance with the disclosure; and, FIG. 19 is an alternate embodiment of the wrench having the retaining surface of the fixed jaw at a 90 degree angle to the centerline of the tool. The cam lever arm is shown in its maximum and minimum travel positions corresponding to the largest and smallest size nut which the embodiment will accept.

FIG. 18 is a side view of the cam wrench of FIG. 1 showing the pivot 20 with a groove 22 to accept the transverse pin 40. Also shown, is the bearing 30, mounted in the lever arm 14.

Figure 19:
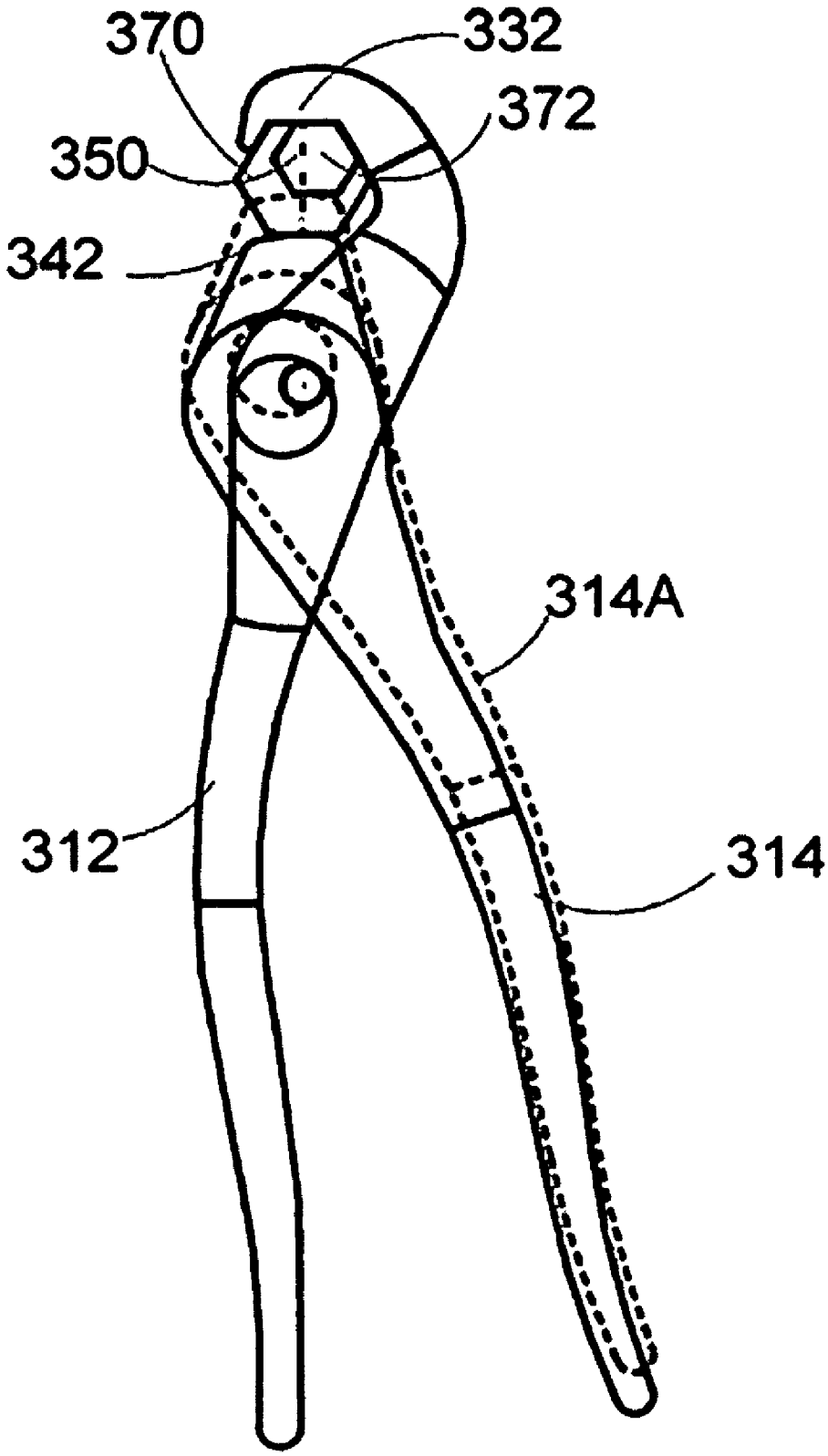

FIG. 19 is a front view of an alternative cam compression tool with the retaining surface of lever arm 314 oriented with the flat retaining surface 332 at a 90 degree angle to the center line 350 of the tool and the lever arm 312 oriented to maintain the cam surface 342 moving through a parallel orientation to said flat retaining surface 332.

In the figure the lever arm 314 and cam surface 342 are positioned for the largest size nut 370 at the maximum travel position and at the positioning 314A corresponding to the smallest nut 372. It should be noted that the separation distance illustrated herein is for example is does not necessarily reflect any proportions or ratios.

It is thus seen that the arm position adjuster mechanism produces a tool that is the equivalent of a tool having a plurality of wrench arms each having a different orientation relative to the fixed pivot.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Broad Scope of the Invention

While illustrative embodiments of the invention have been described herein, the present invention is not limited to the various preferred embodiments described herein, but includes any and all embodiments having equivalent elements, modifications, omissions, combinations (e.g., of aspects across various embodiments), adaptations and/or alterations as would be appreciated by those in the art based on the present disclosure. The limitations in the claims (e.g., including that to be later added) are to be interpreted broadly based on the language employed in the claims and not limited to examples described in the present specification or during the prosecution of the application, which examples are to be construed as non-exclusive. For example, in the present disclosure, the term "preferably" is non-exclusive and means "preferably, but not limited to." In this disclosure and during the prosecution of this application, means-plus-function or step-plus-function limitations will only be employed where for a specific claim limitation all of the following conditions are present in that limitation: a) "means for" or "step for" is expressly recited; b) a corresponding function is expressly recited; and c) structure, material or acts that support that structure are not recited. In this disclosure and during the prosecution of this application, the terminology "present invention" or "invention" may be used as a reference to one or more aspect within the present disclosure. The language of the present invention or inventions should not be improperly interpreted as an identification of criticality, should not be improperly interpreted as applying across all aspects or embodiments (i.e., it should be understood that the present invention has a number of aspects and embodiments), and should not be improperly interpreted as limiting the scope of the application or claims. In this disclosure and during the prosecution of this application, the terminology "embodiment" can be used to describe any aspect, feature, process or step, any combination thereof, and/or any portion thereof, etc. In some examples, various embodiments may include overlapping features. In this disclosure, the following abbreviated terminology may be employed: "e.g." which means "for example."

What is claimed is:

1. An adjustable cam wrench comprising a pair of lever arms, one lever arm having a pocket for a nut or bolt, said pocket being configured to contact from two to three faces of said nut or bolt, the other lever arm having a cam surface, a fixed pivot member, said pivot member forming a fixed pivot point, each of said pair of lever arms being rotatable around said fixed pivot point, one of said lever arms being rotatably fixed to a bearing member and said bearing member being rigidly fixed to said fixed pivot member, said bearing member being rotatably secured to said other lever arm, said bearing member being rotatable about its center, said fixed pivot being fixed to said bearing member at a position such that the center of rotation of said fixed pivot member is non-concentric with respect to said bearing member, a lever arm position adjuster means fixed to said bearing member for rotating said bearing member, a transverse pin, said transverse pin being positioned to lock said lever arm position adjuster means to said bearing member, said position adjuster means is an arm member pivotable about said transverse pin that attaches said arm member to said bearing member, said arm member being pivotable about an axis of said transverse pin transverse to the rotational axis of said bearing member whereby rotation of said adjuster means varies the distance between the cam surface and said pocket.

2. The adjustable cam wrench of claim 1 wherein said bearing member is mounted in the lever arm with said cam surface and wherein said cam surface is convex.

3. The adjustable cam wrench of claim 2 wherein said arm position adjuster further comprises at least one pin extending from said arm position adjuster, said at least one pin being receivable in a plurality of receiving areas in the one of said lever arms rotatably fixed to said bearing member, said receiving areas being dimensioned to receive said at least one pin.

4. The adjustable cam wrench of claim 3 wherein said plurality of receiving areas is greater in number than the at least one pin, whereby said pair of lever arms can be adjusted relative to each other and thereby vary the position of the cam surface relative to said fixed pivot member.

5. The adjustable cam wrench of claim 4 wherein said at least one pin is a plurality of pins and the number said receiving areas is greater than the number said plurality of pins.

6. The adjustable cam wrench of claim 4 wherein said at least one pin is a plurality of pins and the number said receiving areas is greater than the number said plurality of pins and is sufficient to provide a plurality of pin receiving positions.

7. The adjustable cam wrench of claim 2, said convex cam surface being dimensioned to move along a surface of a nut or bolt to a position to create a contact point with said nut or bolt to apply force to said nut or bolt in a direction perpendicular to at least one face of the plurality of faces of said nut or bolt.

8. The adjustable cam wrench of claim 2, said nut or bolt has six faces and said pocket has at least two flat surfaces that receive at least two faces of said nut or bolt.

9. The adjustable cam wrench of claim 3, wherein said lever arm position adjuster means fixed to said bearing member for rotating said bearing member further comprises an opening spring, said lever arm position adjuster being pivotable between a first position and a second position, and spring biased toward said first position, and wherein in said first position said at least one pin being received in a receiving area and in said second position said at least one pin not being in a receiving area.

* * * * *